US008453958B2

(12) United States Patent
Tokunaga et al.

(10) Patent No.: US 8,453,958 B2
(45) Date of Patent: Jun. 4, 2013

(54) METHOD OF WINDING TAPE-LIKE MULTI-LAYER FILM AND WOUND ARTICLE OF TAPE-LIKE MULTI-LAYER FILM

(75) Inventors: Hisatsugu Tokunaga, Isesaki (JP); Satoshi Mizushima, Isesaki (JP)

(73) Assignee: Denki Kagaku Kogyo Kabushiki Kaisha, Tokyo (JP)

( * ) Notice: Subject to any disclaimer, the term of this patent is extended or adjusted under 35 U.S.C. 154(b) by 107 days.

(21) Appl. No.: 12/936,085

(22) PCT Filed: Feb. 17, 2009

(86) PCT No.: PCT/JP2009/052722

§ 371 (c)(1),
(2), (4) Date: Oct. 1, 2010

(87) PCT Pub. No.: WO2009/122795

PCT Pub. Date: Oct. 8, 2009

(65) Prior Publication Data

US 2011/0024541 A1 Feb. 3, 2011

(30) Foreign Application Priority Data

Apr. 2, 2008 (JP) ..... 2008-096494

(51) Int. Cl.
*B65H 23/18* (2006.01)

(52) U.S. Cl.
USPC ..... 242/412; 242/530.2

(58) Field of Classification Search
USPC ..... 242/530.2, 412, 160.4
See application file for complete search history.

(56) References Cited

U.S. PATENT DOCUMENTS

| | | | | |
|---|---|---|---|---|
| 3,226,816 | A * | 1/1966 | Wilson et al. | 29/430 |
| 3,226,911 | A * | 1/1966 | Vreeland et al. | 53/450 |
| 2002/0117573 | A1 | 8/2002 | Nakata et al. | |

FOREIGN PATENT DOCUMENTS

| | | |
|---|---|---|
| JP | 50 72235 | 6/1975 |
| JP | 53-49692 | 5/1978 |
| JP | 53 46186 | 12/1978 |
| JP | 55 44413 | 3/1980 |
| JP | 3 288752 | 12/1991 |
| JP | 4 301253 | 10/1992 |
| JP | 11-106099 | 4/1999 |
| JP | 2002 187649 | 7/2002 |
| JP | 2002 274707 | 9/2002 |
| JP | 2005 206301 | 8/2005 |
| JP | 2006 225135 | 8/2006 |
| JP | 2008-69240 | 3/2008 |

OTHER PUBLICATIONS

International Search Report issued May 12, 2009 in PCT/JP09/052722 filed Feb. 17, 2009.

* cited by examiner

*Primary Examiner* — Sang Kim
(74) *Attorney, Agent, or Firm* — Oblon, Spivak, McClelland, Maier & Neustadt, L.L.P.

(57) ABSTRACT

A method of winding a tape-like laminated film in a disk form, in which the winding tension force applied to the tape-like laminated film is so controlled as to be 0%/winding meters to +0.10%/winding meters to the tension value at the start of winding in accordance with the length of the tape-like laminated film wound around a core. According to this method, the occurrence of the deformation and the winding breakage of the tape-like laminated film during the transportation and storage thereof can be suppressed.

5 Claims, 1 Drawing Sheet

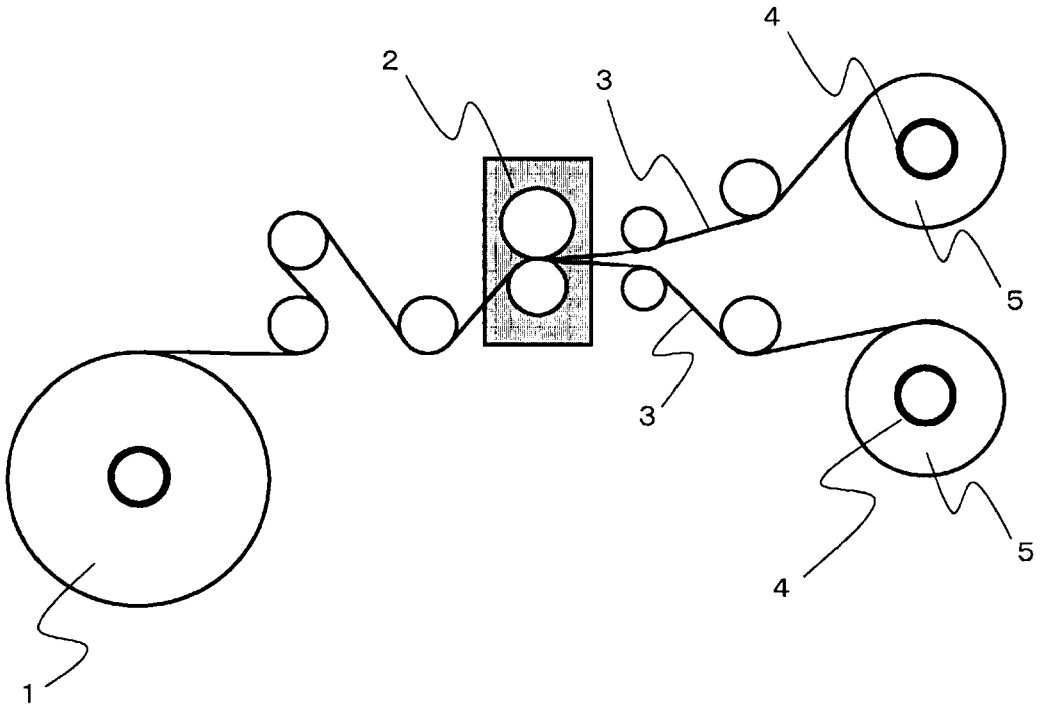
1
2
3
3
4
4
5
5

METHOD OF WINDING TAPE-LIKE MULTI-LAYER FILM AND WOUND ARTICLE OF TAPE-LIKE MULTI-LAYER FILM

TECHNICAL FIELD

The present invention concerns a method for winding a tape-like multi-layer film in a record-like manner, and in addition, a wound article of tape-like multi-layer film that has been wound using said winding method. An example of the tape-like multi-layer film is a tape-like multi-layer film that has been slit into a narrow width, such as a cover tape for carrier tape that is used when transporting electronic parts.

BACKGROUND ART

Due to convenience of storage and transportation, film that has been slit into a tape form is normally bought and sold in a form where it is wound onto a winding core, that is, as a wound article. For example, cover tape that is used for enclosing chip-shaped electronic parts such as ICs, is slit in the form of a tape-like multi-layer film having a narrow width, from an original film having a wide width, and is distributed in a state where it is wound onto an appropriate winding core.

As a method for winding film that has been slit into a tape form, generally, a method called "record winding" and in addition, a method called "traverse winding" or "spool winding" are known.

The winding method known as record winding is a method whereby a tape-like film is wound in the form of a roll onto a winding core having a winding width that is approximately the same as the width of the tape-like film, without displacing the winding position, and generally, it is utilized in cases where a relatively short tape-like film of several hundred meters is being wound.

Additionally, the winding method known as traverse winding or spool winding is a method whereby a tape-like film is wound in the form of a spiral onto a winding core having a winding width wider than the width of the tape-like film, while continuously displacing the winding position, and generally, it is utilized in cases where a long winding with a length of several thousand meters is necessary.

In particular, record winding is preferred in most cases because of a good outer appearance upon winding, and in addition, because it is less bulky relative to traverse winding, so the space required for packing can be small.

Record winding is utilized in various fields, and there have been attempts to improve this winding method. Generally, with regard to methods for winding tape that has been slit into a narrow width, it was thought that instead of winding at a constant tension, the so-called taper winding method, whereby the tension more or less decreases in accordance with the winding diameter, made for a stable wound state (Patent Document 1). Other than this method, a method wherein during winding of a magnetic tape or the like, a supporting portion of a touch roll is moved so as to follow the winding diameter (Patent Document 2), a method wherein during winding of a nonwoven fabric or the like, it is controlled by using a press roll as a pressing load at the start of winding and at the end of winding (Patent Document 3), and the like have been suggested.

Patent Document 1: JP-A S55-044413
Patent Document 2: JP-A 2005-206301
Patent Document 3: JP-A 2006-225135

DISCLOSURE OF THE INVENTION

As stated above, generally, in cases where a film slit into a tape form is wound in the manner of a record, in order to avoid overtight winding, a method is used whereby the tension on the tape is lowered in accordance with the progression of the winding. If overtight winding occurs, the wound appearance of the wound article becomes disarrayed and this impairs storage and transportation, and in addition, it warps the shape of the tape itself, and in the worst cases, it cannot even be used. Particularly, if overtight winding of a tape-like multi-layer film comprising a plurality of layers with differing materials occurs, the thickness and form of each of the layers individually changes, in some cases causing layer separation, and this may in some cases have a catastrophic effect on the functioning of the entire film. Therefore, particularly in cases of record winding of a tape-like multi-layer film, due to the necessity of avoiding overtight winding, the tension on the tape was generally lowered bit by bit.

Additionally, in cases of a narrow width tape that is substantially a single layer tape, and when the surface thereof has slipperiness, like magnetic tape, it is relatively easy to form the thickness of the tape in the width direction uniformly. Even if record winding is done on this kind of tape, since the air dissipates outside the wound article at the time of winding, air does not remain within the wound article. In contrast, in cases of tape-like multi-layer films constituted in such a way that a layer of an adhesive agent (seal layer) is separately formed on a film layer that forms a substrate, as in particular for cover tape, it is difficult to make the thickness in the width direction strictly uniform. Additionally, in cases where tape of this constitution is wound in layers, the seal layer having the thickness nonuniformity of the tape-like multi-layer film that is on top of it, adheres to the film layer of the tape-like multi-layer film that is on the bottom, and an air-tight space is unavoidably created. The air that has been taken into this space cannot break through the surrounding air-tight state, so the air that was taken in during winding cannot dissipate to the outside of the wound article. In this way, the air that is taken into the wound article, compared to the material that constitutes the film layer, is strongly influenced by temperature changes and the like during storage and transportation, and expands or contracts, and thereby causes the loosening and unwinding of the wound article, or causes a lifting up at the outer edges through the deformation by warping of the wound article into a dish shape. Because of this, in cases where tape-like multi-layer films are record wound, problems due to changes in the ambient environmental like loosening and unwinding and warping arose more significantly than in tape-like films comprising single layers.

In this way, a winding method for record winding a tape-like multi-layer film constituted from a plurality of layers without giving rise to warping or loosening and unwinding was sought.

The present invention was made in light of the circumstances described above, and provides a method for winding tape-like multi-layer film that can suppress the occurrence of deformation of the winding state or loosening and unwinding during transportation or storage, and additionally it provides a wound article that is wound by using said winding method.

The present inventors, upon having keenly investigated a method for solving said problem, found that the winding state of a wound article during transportation or storage becomes stable if the winding tension on a tape-like multi-layer film is increased at a predetermined ratio in accordance with the length of the tape-like multi-layer film that is wound on a winding core, during winding of a tape-like multi-layer film in a record-like manner, and thereby came upon the present invention.

That is, according to the present invention, a method for winding a tape-like multi-layer film is provided, characterized in being a method for winding a tape-like multi-layer film onto a winding core in a record-like manner, wherein the winding tension of the tape-like multi-layer film is controlled in accordance with the length of the tape-like multi-layer film that has been wound on the winding core, so that it is 0% per meter wound or more, and +0.10% per meter wound or less, relative to the tension at the start of winding.

According to said winding method, warping of the wound article and loosening and unwinding during transportation or storage can be prevented. Additionally, the problem of over-tight winding that is of particular concern for tape-like multi-layer films, does not occur.

According to the present invention, not only can the wound state of a tape-like multi-layer film wound in a record-like manner be carried out excellently, but a method for winding tape-like multi-layer film whereby this excellent state is maintainable even after winding during transportation or storage, and in addition a wound article of a tape-like multi-layer film that is wound in a record-like manner can be provided.

BRIEF EXPLANATION OF THE DRAWINGS

FIG. 1 Drawing showing the winding method according to the present invention schematically

1 original multi-layer film
2 slitting device
3 tape-like multi-layer film
4 winding core
5 record-like winding article

MODES FOR EMBODYING THE INVENTION

Herebelow, embodiments of the present invention shall be explained using drawings. In all of the drawings, the same reference numbers shall be assigned to similar constituent elements, and explanations shall be omitted as appropriate.

<Overview of Winding Method of Tape-Like Multi-Layer Film>

FIG. 1 is a conceptual diagram explaining the winding method of the tape-like multi-layer film of the present embodiment. The winding method for a tape-like multi-layer film of the present embodiment, as shown in FIG. 1, is carried out by using an original multi-layer film 1, a slitting device 2 for slitting said original multi-layer film 1 into a tape form having a predetermined width, a slit tape-like multi-layer film 3, and an winding core 4. The winding core 4 and the tape-like multi-layer film 3 wound thereon in a record-like manner, obtained by said winding method, are together called the record-like wound article 5.

<Original Multi-Layer Film and Tape-Like Multi-Layer Film>

The original multi-layer film 1 and the tape-like multi-layer film 3 that is the result of having slit this, are generally constituted from a plurality of layers comprising different resins.

Typically, it is possible to use films where a plurality of films made by forming industrially used resin in a thin film form are laminated, or films made by integrally forming by applying resin that constitutes a seal layer onto said film. Here, the film that is the base material for applying the seal layer may have a single layer structure, or a multi-layer structure.

The resins for constituting said film are not particularly restricted, but examples are polyesters such as polyethylene terephthalate (PET), polyethylene naphthalate (PEN), and mixtures of polyethylene terephthalate and polyethylene naphthalate, polyolefins such as polypropylene and polyethylene, polyvinyl chloride based resins, and styrene based resins.

As resins for constituting said seal layer, olefin based resins or styrene based resins or mixtures thereof may be used, but they are not restricted to these resins.

The thickness of the original multi-layer film 1 and the tape-like multi-layer film 3 is not particularly restricted, but it is 0.03 mm or more and 2 mm or less, preferably 0.1 mm or less, and even more preferably 0.08 mm or less. In cases where the thickness is 0.03 mm or more, it becomes difficult for trouble such as tape breakage to occur when the tape-like multi-layer film 3 is being wound to the winding core 4, or when the tape-like multi-layer film 3 is being wound off from a wound state, so it is preferable. On the other hand, from the standpoint of ease of handling and the main applications, it is preferable to make the thickness of the tape-like multi-layer film 3 be 2 mm or less.

The width of the original multi-layer film 1 is not particularly restricted. It may depend on the processing facility, but generally, it can have a width of between several hundred mm to several thousand mm.

The width of the tape-like multi-layer film 3 that is slit from the original multi-layer film 1, that is, the width, is not particularly restricted, but generally, it is 1 mm or greater, and 50 mm or less, and preferably is 10 mm or less. In cases where this width is 1 mm or greater, it is difficult for loosening and unwinding to occur during transportation or during storage, so this is preferable. On the other hand, from the standpoint of ease of handling and the main applications, it is preferable to make the width of the tape-like multi-layer film 3 be 50 mm or less.

The length of the original multi-layer film 1 and the tape-like multi-layer film 3 is not particularly restricted, but in consideration of ease of handling, main applications, and the realities of the market, it is typically 100 m or more, and 800 m or less. Generally, in order to maintain the wound state stably, it is advantageous for the winding length to be shorter.

<Slitting Device>

The slitting device 2 is not particularly restricted, and various slitting devices that are generally used may be used. For example, a device utilizing the shear cut method wherein an original multi-layer film 1 is slit by shearing it between a lower blade and an upper blade may be suitably used.

<Winding Core>

For the winding core 4, one that is constituted from paper material or from plastic material may be used suitably. It is preferable to use a plastic material from the standpoint of durability against the stress on the winding core 4 when winding the tape-like multi-layer film 3. Additionally, resin to which glass fibers have been added may be used as the constituent material for the winding core, with the aim of improving the strength of the winding core 4.

The outer diameter of the winding core 4 is not particularly restricted, but it is preferably 86 mm or more, and 100 mm or less. If it is 86 mm or more, since the winding bias when the tape-like multi-layer film 3 is wound out can be suppressed, handling during use becomes easy. Additionally, due to the ease of handling during storage and transportation, it is preferable for it to be 100 mm or less.

The winding width of the winding core 4 depends upon the width of the tape-like multi-layer film 3 that is to be wound on it, and for example it is preferable for it to be the same width or slightly wider than the tape-like multi-layer film 3.

<Winding Tension>

The "winding tension" in the present invention refers to the force with which a tape-like multi-layer film 3 is pulled in its longitudinal direction at the winding position, during winding of the tape-like multi-layer film 3 onto the winding core 4.

The winding tension is controlled so that, in accordance with the length of the tape-like multi-layer film 3 wound on the winding core 4, the rate of change is 0% per meter wound or more relative to the tension value at the start of winding, and it is +0.10% per meter wound or less, more preferably +0.07% per meter wound or less. In more detail, if the value of the winding tension at the start of winding (length of tape wound onto winding core=0 m) is $Y_0$ (gf), and the rate of change of the tension is a (% per meter wound), the value of the winding tension [$Y_x$ (gf)] at the time when the length of tape-like multi-layer film 3 wound onto the winding core is X(m), is given by the following equation:

$$Y_x=Y_0(1+aX/100)$$

Therefore, the value of the winding tension $Y_x$ is determined based upon the value of the tension at the start of winding $Y_0$ and the set rate of change a. For example, if the value of the tension on the tape-like multi-layer film 3 at the start of winding is 100 gf, and if 500 meters are to be wound with the rate of change of the winding tension at +0.05% per meter wound, then at the point where 100 meters have been wound, the value of the tension is 105 gf, and the value of the tension when 200 meters have been wound is 110 gf, and the value of the tension at the time it has been completely wound is 125 gf.

In order to wind the tape-like multi-layer film 3 in a record-like manner without causing winding disarray or loosening and unwinding, it is necessary to make said rate of change of the winding tension a be 0% per meter wound or greater, and +0.10% per meter wound or less.

In cases where the rate of change a is negative, that is, if the winding tension is lowered as a greater length is wound, the state immediately after winding is stable, but deformations of the winding state and the occurrence of loosening and unwinding at the time of transportation and storage can be seen. For this reason, in order to avoid warping or loosening and unwinding, it is necessary to make the rate of change be 0% or greater. On the other hand, if the rate of change is +0.10% or less, then winding defects such as loosening and unwinding do not occur during winding, and additionally, the problem of overtight winding due to the winding tension being too strong does not occur.

The value of the tension at the start of winding is not particularly restricted, but it is preferable for this to be 30 gf or greater, and 600 gf or less. It is preferable for this to be 30 gf or greater because winding defects during winding do not occur. Additionally, it is preferable for this to be 600 gf or less, because the problem of overtight winding due to excessive tension being added does not occur.

<Winding Tension Control Method>

When winding a tape-like multi-layer film 3 onto a winding core 4, it is preferable for a plurality of tape-like multi-layer films 3 slit simultaneously from one original multi-layer film 1 to be wound individually and simultaneously onto a plurality of winding shafts (not shown) whereon winding cores 4 have been mounted. In this case, it is preferable to be able to detect the winding tension on each tape-like multi-layer film 3 individually on each winding shaft, and make adjustments automatically.

Examples of methods for controlling the winding tension are a control method using the friction on the shaft bearings called ball bearings or thrust bearings in each of the winding shafts (not shown) on which the winding cores 4 are mounted, a control method using the resistance force caused by magnets, and the like, but this is not particularly restricted as long as it is a method whereby the winding tension on the tape-like multi-layer films 3 can be individually controlled.

<Winding Method>

The method for winding a tape-like multi-layer film 3 in a tape-like manner is not restricted as long as the rate of change of the winding tension on the tape-like multi-layer film 3 can be adjusted so it is in said range. Here, the winding method according to the present invention shall be explained in accordance with FIG. 1.

First, an original multi-layer film 1 having a wide width, wound in a roll-like manner, is wound out, and is slit into a plurality of strips having a predetermined width by a slitting device 2.

Next, the slit tape-like multi-layer films 3 are wound onto a winding core 4 mounted on a winding shaft (not shown). At this time, in order for the winding appearance to be record-like, the winding position relative to the winding core 4 is maintained at a constant position using a guide or the like (not shown), and simultaneously, the winding tension on the tape-like multi-layer films 3 is adjusted individually by a friction control mechanism or the like provided on the winding shaft (not shown). The winding tension on the tape-like multi-layer film is controlled so that, in accordance with the length of the tape-like multi-layer film wound onto the winding core, it increases in the range of 0 to +0.10% per meter wound relative to the value of the tension at the start of winding.

FIG. 1 shows, for convenience, one original multi-layer film 1 being slit into two tape-like multi-layer films 3, and these being individually and simultaneously record wound onto two winding cores 4, but it is of course possible for this to be slit into a larger number of tape-like multi-layer films 3, and winding using a corresponding number of winding cores 4.

<Actions And Effects>

Herebelow, the actions and effects of the winding method for tape-like multi-layer films of the present mode of embodiment shall be explained with reference to FIG. 1.

In the winding method for tape-like multi-layer films 3 of the present mode of embodiment, the winding tension on the tape-like multi-layer films 3 is controlled so that, in accordance with the length of the tape-like multi-layer film wound onto the winding core 4, it is 0% per meter wound or greater, and +0.10% per meter wound or less relative to the value of the tension at the start of winding.

Due to this constitution, even multi-layer films, for which it is difficult to form the thickness uniformly relative to a film having a single-layer structure, and therefore easily causes the winding in of air that causes loosening and unwinding and the like, can be wound in a record-like manner so as not to cause winding abnormalities such as loosening and unwinding or the like during transportation or storage.

Additionally, it is preferable for the width of the tape-like multi-layer film to be 1 mm or more, and 50 mm or less.

In this case, it is difficult for trouble such as tape breakage to occur, and handling is also easy.

Further, it is preferable for the thickness of the tape-like multi-layer film to be 0.03 mm or more, and 2 mm or less.

In this case, it is difficult for loosening and unwinding to occur during transportation or storage, and handling is easy.

Additionally, in the winding method according to the present invention, the tape-like multi-layer film 3 may appropriately be used as a cover tape for a carrier tape.

A cover tape for a carrier tape is generally a multi-layer film having a resin film layer and a seal layer, so it is difficult to form the thickness of the tape uniformly, and it was especially difficult to prevent winding abnormalities such as loosening and unwinding in cases where it is wound in a record-like manner. In the winding method according to the present invention, since abnormalities of the winding state are not caused even for tape-like multi-layer films having a non-uniform thickness, it can be applied especially appropriately for cover tapes for carrier tapes.

Additionally, the record-like wound article 5 of a tape-like multi-layer film wound by the above winding method for tape-like multi-layer films, can be used appropriately.

Said record-like wound article 5 has a low occurrence of winding state abnormalities such as loosening and unwinding during transportation and storage.

The modes of embodiment of the present invention have been described above with reference to drawings, but these are mere examples of the present invention, and various constitutions other than those described above may be utilized.

For example, an example was given of a method of controlling the winding tension on the tape-like multi-layer film 3 during winding in the above modes of embodiment, but it can be a constitution wherein, in addition to controlling the winding tension, winding is done while pushing the tape-like multi-layer film 3 towards the winding core side with a touch roll or a press roll or the like. By adding the pressing force, the air that is wound into the tape-like multi-layer film 3 during winding can be decreased, so that it can be expected that deformations of the winding state and the occurrence of loosening and unwinding during transportation and storage can be effectively controlled. As methods for adding a pressing force, there is a method of maintaining a constant pressure from the start of winding, or there is the method of adjusting the force appropriately in accordance with the winding radius.

EMBODIMENT EXAMPLES

Herebelow, the present invention shall be further described using examples, but the present invention is not limited to these examples.

Embodiment 1

A tape-like multi-layer film cut so as to have a width of approximately 5 mm from an original multi-layer film having a width of 440 mm comprising in order biaxial stretched polyethylene terephthalate film having a thickness of 16 μm (substrate layer), an isocyanate based anchor coating agent layer, a polyethylene based resin layer having a thickness of 38 μm (intermediate layer), and a styrene based resin layer having a thickness of 8 μm (seal layer), was wound on a winding core having an outer diameter of 93 mm at a winding rate of 50 m/min. Winding was started with the winding tension on the tape-like multi-layer film at 55 gf, the rate of change of the winding tension relative to the value of the tension at the start of winding was set at +0.05% per meter wound, and 480 m were wound. The value of the tension when 480 m had been wound was 68 gf. During winding, no occurrence of overtight winding was observed.

Embodiment 2

Winding was done in a similar manner to Embodiment 1, with the exceptions that winding was started with the winding tension on the tape-like multi-layer film at 41 gf, and the rate of change of the winding tension relative to the value of the tension at the start of winding was set at +0.10% per meter wound. The value of the tension when 480 m had been wound was 61 gf. During winding, no occurrence of overtight winding was observed.

Embodiment 3

Winding was done in a similar manner to Embodiment 1, with the exceptions that winding was started with the winding tension on the tape-like multi-layer film at 41 gf, and the rate of change of the winding tension relative to the value of the tension at the start of winding was set at 0% per meter wound. The value of the tension when 480 m had been wound was 41 gf. During winding, no occurrence of overtight winding was observed.

Embodiment 4

Winding was done in a similar manner to Embodiment 1, with the exceptions that the width of the tape-like multi-layer film was approximately 9 mm, and in addition, winding was started with the winding tension on the tape-like multi-layer film at 158 gf, and the rate of change of the winding tension relative to the value of the tension at the start of winding was set at +0.05% per meter wound. The value of the tension when 480 m had been wound was 196 gf. During winding, no occurrence of overtight winding was observed.

Embodiment 5

Winding was done in a similar manner to Embodiment 1, with the exceptions that the width of the tape-like multi-layer film was approximately 9 mm, and in addition, winding was started with the winding tension on the tape-like multi-layer film at 158 gf, and the rate of change of the winding tension relative to the value of the tension at the start of winding was set at +0.10% per meter wound. The value of the tension when 480 m had been wound was 234 gf. During winding, no occurrence of overtight winding was observed.

Embodiment 6

Winding was done in a similar manner to Embodiment 1, with the exceptions that the width of the tape-like multi-layer film was approximately 9 mm, and in addition, winding was started with the winding tension on the tape-like multi-layer film at 158 gf, and the rate of change of the winding tension relative to the value of the tension at the start of winding was set at 0% per meter wound. The value of the tension when 480 m had been wound was 158 gf. During winding, no occurrence of overtight winding was observed.

Embodiment 7

Winding was done in a similar manner to Embodiment 1, with the exceptions that the width of the tape-like multi-layer film was approximately 13 mm, and in addition, winding was started with the winding tension on the tape-like multi-layer film at 197 gf, and the rate of change of the winding tension relative to the value of the tension at the start of winding was set at +0.05% per meter wound. The value of the tension when 480 m had been wound was 244 gf. During winding, no occurrence of overtight winding was observed.

Embodiment 8

Winding was done in a similar manner to Embodiment 1, with the exceptions that the width of the tape-like multi-layer film was approximately 13 mm, and in addition, winding was started with the winding tension on the tape-like multi-layer film at 197 gf, and the rate of change of the winding tension relative to the value of the tension at the start of winding was set at +0.10% per meter wound. The value of the tension when 480 m had been wound was 292 gf. During winding, no occurrence of overtight winding was observed.

Embodiment 9

Winding was done in a similar manner to Embodiment 1, with the exceptions that the width of the tape-like multi-layer film was approximately 13 mm, and in addition, winding was started with the winding tension on the tape-like multi-layer film at 197 gf, and the rate of change of the winding tension relative to the value of the tension at the start of winding was set at 0% per meter wound. The value of the tension when 480 m had been wound was 197 gf. During winding, no occurrence of overtight winding was observed.

Comparative Example 1

Winding was done in a similar manner to Embodiment 1, with the exceptions that winding was started with the winding tension on the tape-like multi-layer film at 68 gf, and the rate of change of the winding tension relative to the value of the tension at the start of winding was set at −0.04% per meter wound. The value of the tension when 480 m had been wound was 55 gf. During winding, no occurrence of overtight winding was observed.

Comparative Example 2

Winding was done in a similar manner to Embodiment 1, with the exceptions that winding was started with the winding tension on the tape-like multi-layer film at 41 gf, and the rate of change of the winding tension relative to the value of the tension at the start of winding was set at +0.15% per meter wound. The value of the tension when 480 m had been wound was 71 gf. During winding, no occurrence of overtight winding was observed.

Comparative Example 3

Winding was done in a similar manner to Embodiment 1, with the exceptions that the width of the tape-like multi-layer film was approximately 9 mm, and in addition, winding was started with the winding tension on the tape-like multi-layer film at 158 gf, and the rate of change of the winding tension relative to the value of the tension at the start of winding was set at −0.04% per meter wound. The value of the tension when 480 m had been wound was 128 gf. During winding, no occurrence of overtight winding was observed.

Comparative Example 4

Winding was done in a similar manner to Embodiment 1, with the exceptions that the width of the tape-like multi-layer film was approximately 9 mm, and in addition, winding was started with the winding tension on the tape-like multi-layer film at 158 gf, and the rate of change of the winding tension relative to the value of the tension at the start of winding was set at +0.15% per meter wound. The value of the tension when 480 m had been wound was 272 gf. During winding, no occurrence of overtight winding was observed.

Comparative Example 5

Winding was done in a similar manner to Embodiment 1, with the exceptions that the width of the tape-like multi-layer film was approximately 13 mm, and in addition, winding was started with the winding tension on the tape-like multi-layer film at 197 gf, and the rate of change of the winding tension relative to the value of the tension at the start of winding was set at −0.04% per meter wound. The value of the tension when 480 m had been wound was 159 gf. During winding, no occurrence of overtight winding was observed.

Comparative Example 6

Winding was done in a similar manner to Embodiment 1, with the exceptions that the width of the tape-like multi-layer film was approximately 13 mm, and in addition, winding was started with the winding tension on the tape-like multi-layer film at 197 gf, and the rate of change of the winding tension relative to the value of the tension at the start of winding was set at +0.15% per meter wound. The value of the tension when 480 m had been wound was 339 gf. During winding, no occurrence of overtight winding was observed.

<Evaluation of the Winding State>

The winding state was evaluated for wound articles of tape-like multi-layer films wound as described above.

This evaluation was carried out, in consideration of various transportation and storage environments, after leaving the tape-like multi-layer films in a high temperature or a low temperature, as described below.

High Temperature Environment Introduction Test

A tape-like multi-layer film wound onto a winding core was housed in a box comprising corrugated cardboard having a thickness of approximately 7 mm, with inner dimensions of length approximately 220 mm×width approximately 220 mm×height approximately 180 mm, and this was left for 2 hours in an oven set at 60 degrees Celsius. After taking out from the oven, and leaving for 24 hours or longer in an environment of temperature 23 degrees Celsius and humidity 50%, it was removed from the box, and the winding state of the tape-like multi-layer film was evaluated.

Low Temperature Environment Introduction Test

A tape-like multi-layer film was left for 1 hour in a refrigerator set at 15 degrees Celsius in an exposed state, and the winding state was evaluated inside the refrigerator.

The results of the evaluation of the winding state are shown in table 1 below.

TABLE 1

| | | Rate of Change of Winding | Evaluation of Winding State | | | |
|---|---|---|---|---|---|---|
| | | | High Temperature Environment | | Low Temperature Environment | |
| | Cutting Width (mm) | Tension (% per meter wound) | Loosening and unwinding | Warping | Loosening and unwinding | Warping |
| Emb. 1 | Approx. 5 mm | +0.05% | ○ | ○ | ○ | ○ |
| Emb. 2 | Approx. 5 mm | +0.10% | ○ | ○ | ○ | ○ |

TABLE 1-continued

| | Cutting Width (mm) | Rate of Change of Winding Tension (% per meter wound) | Evaluation of Winding State: High Temperature Environment: Loosening and unwinding | High Temperature Environment: Warping | Low Temperature Environment: Loosening and unwinding | Low Temperature Environment: Warping |
|---|---|---|---|---|---|---|
| Emb. 3 | Approx. 5 mm | 0% | ○ | ○ | ○ | ○ |
| Comp. Ex. 1 | Approx. 5 mm | −0.04% | x | ○ | x | ○ |
| Comp. Ex. 2 | Approx. 5 mm | +0.15% | x | x | x | ○ |
| Emb. 4 | Approx. 9 mm | +0.05% | ○ | ○ | ○ | ○ |
| Emb. 5 | Approx. 9 mm | +0.10% | ○ | ○ | ○ | ○ |
| Emb. 6 | Approx. 9 mm | 0% | ○ | ○ | ○ | ○ |
| Comp. Ex. 3 | Approx. 9 mm | −0.04% | x | ○ | x | ○ |
| Comp. Ex. 4 | Approx. 9 mm | +0.15% | x | x | x | ○ |
| Emb. 7 | Approx. 13 mm | +0.05% | ○ | ○ | ○ | ○ |
| Emb. 8 | Approx. 13 mm | +0.10% | ○ | ○ | ○ | ○ |
| Emb. 9 | Approx. 13 mm | 0% | ○ | ○ | ○ | ○ |
| Comp. Ex. 5 | Approx. 13 mm | −0.04% | x | ○ | x | ○ |
| Comp. Ex. 6 | Approx. 13 mm | +0.15% | x | x | x | ○ |

In table 1, each symbol below has the following meaning.

1. Loosening and unwinding
   - ○ (Good): Loosening and unwinding does not occur when wound article is lifted up while holding outer periphery
   - x (Poor): Loosening and unwinding occurs when wound article is lifted up while holding outer periphery
2. Warping
   - ○ (Good): Lifting up of outer periphery edge is less than 1 mm
   - x (Poor): Lifting up of outer periphery edge is 1 mm or greater <Comments on Tests>

As is obvious from table 1, with regard to cases where the winding tension was adjusted in accordance with the winding length of the tape-like multi-layer film, so that it is 0% per meter wound or more, and +0.10% per meter wound or less relative to the winding tension at the start of winding, winding abnormalities such as warping or loosening and unwinding or the like could not be observed. In addition, within the range evaluated, no substantial correlation could be observed between the winding state and the cutting width of the tape-like multi-layer film.

We have explained the present invention based upon embodiment examples. These embodiment examples are merely examples, and it should be understood by those skilled in the art that various modifications are possible, and such modifications are within the scope of the present invention.

INDUSTRIAL APPLICABILITY OF THE INVENTION

The winding method for a tape-like multi-layer film according to the present invention may readily be applied to processing facilities having common specifications, and can particularly be favorably used in cover tapes for carrier tapes and the like where the control of the winding state with high precision is required.

The invention claimed is:

1. A method of record winding a multi-layer film comprising a cover tape for a carrier tape, the cover tape comprising a resin film layer and a seal layer, to a winding core, the method comprising steps of:

record winding a multi-layer film onto a winding core; and increasing a winding tension $Y_x$ on the multi-layer film in accordance with a length of the multi-layer film wound on a winding core by 0.10% per meter wound or less, relative to a value of the tension at a start of the winding, according to the equation:

$$Y_x = Y_0(1 + aX/100),$$

where $Y_0$ is the value of the winding tension at the start of winding where the length of tape wound onto the winding core is zero, a is the rate of change of the tension in % per meter wound, and $Y_x$ is the value of the winding tension at the time when the length, in meters, of the multi-layer film wound on the winding core is X.

2. The method for winding a multi-layer film according to claim 1, wherein the width of the multi-layer film is 1 mm or more, and 50 mm or less.

3. The method for winding multi-layer film according to claim 1, wherein the thickness of the multi-layer film is 0.03 mm or more, and 2 mm or less.

4. The method for winding a multi-layer film according to claim 1, wherein the multi-layer film is a cover tape for a carrier tape.

5. A wound article of multi-layer film, wound in a method for winding a multi-layer film recited in claim 1.

* * * * *